United States Patent [19]

Dison

[11] Patent Number: 4,770,564

[45] Date of Patent: Sep. 13, 1988

[54] MINING SUPPORT PILLARS

[76] Inventor: Leon Dison, P.O. Box 376, Bergvlei, 2012 Transvaal Province, South Africa

[21] Appl. No.: 139,151

[22] Filed: Dec. 28, 1987

Related U.S. Application Data

[63] Continuation of Ser. No. 852,799, Apr. 16, 1986.

[51] Int. Cl.[4] ..... E02D 15/00

[52] U.S. Cl. ..... 405/288; 405/258; 405/303

[58] Field of Search ..... 405/288, 258, 203, 204, 405/263, 284, 286, 287

[56] References Cited

U.S. PATENT DOCUMENTS

| | | | |
|---|---|---|---|
| 4,009,580 | 3/1977 | Dowse | 405/204 |
| 4,081,970 | 4/1978 | Dowse | 405/204 |
| 4,425,057 | 1/1984 | Hahn | 405/258 |
| 4,468,154 | 8/1984 | Janssen et al. | 405/258 X |
| 4,497,597 | 2/1985 | Chlumecky | 405/258 X |
| 4,530,622 | 7/1985 | Mercer | 405/258 |

FOREIGN PATENT DOCUMENTS

| | | | |
|---|---|---|---|
| 2626650 | 12/1977 | Fed. Rep. of Germany | 405/258 |
| 5866 | 11/1983 | South Africa . | |

OTHER PUBLICATIONS

Journal of the South African Institute of Mining and Metallurgy, No. 11, vol. 78—Jun. 1978, pp. 275-296.

Association of Mine Managers of South Africa—Papers and Discussion 1974-1975—The Chamber of Mines of South Africa—1977—pp. 131 to 142.

The Strength of Large Concrete Blocks Subjected to Concentrated Loads—by P. W. Keene—The Civil Engineer in South Africa—Apr. 1981—pp. 127 to 135.

Support in Shallow Mines Using Horizontally Reinforced Systems—by J. A. Hahn, G. E. Blight, and L. Dison—Journal of the South African Institute of Mining and Metallurgy—Oct. 1982—pp. 277 to 290.

Discussion: Support in Shallow Mines Using Horizontally Reinforced Systems—Contributed by M. D. G. Salamon—and also contribution by H. Wagner and E. Madden, Journal of the South African Institute of Mining and Metallurgy—Jun. 1983—pp. 142 to 150.

Report on an Investigation of Portland Cement/Asbestos Mine Sludge Composites for use as Support Packs in Mines—by J. J. J. Van Rensburg, J. E. Kruger and E. H. L. Kloppers—National Building Research Institute—Council for Scientific and Industrial Research Pretoria—1983.

*Primary Examiner*—Dennis L. Taylor

*Attorney, Agent, or Firm*—Browdy and Neimark

[57] ABSTRACT

A mining support pillar adapted to provide support between the floor and the roof of a mine, includes particulate material within an envelope of synthetic plastics sheet material, and a plurality of layers of reinforcing material of ductile metal at different elevations in or between layers of the particulate material. The ductile metal has an elongation of at least one-sixth, and preferably more than one-fifth, say, one-quarter or more. The particulate material may be in the form of a plurality of building elements arranged in successive courses on top of one another. The layers of reinforcing material may be provided within at least some of the building elements, or between at least some of the courses. The building elements, singly or in groups, are sheathed or wrapped in synthetic plastics sheet material.

14 Claims, 5 Drawing Sheets

MINING SUPPORT PILLARS

This application is a continuation of application Ser. No. 852,799, filed Apr. 16, 1986.

BACKGROUND OF THE INVENTION

This invention relates to underground mining support pillars between floor or foot wall and roof or hanging wall.

It is desirable for such pillars to take the load without sudden failure when floor and roof converge.

Supports of this type are being sought which provide an acceptable load characteristic at an acceptable cost.

SUMMARY OF THE INVENTION

According to one aspect of the invention, there is provided a mining support pillar adapted to provide support between the floor and the roof of a mine, the pillar including particulate material within an envelope of synthetic plastics sheet material, and a plurality of layers of reinforcing material of ductile metal at different elevations in or between layers of the prticulate material, the ductile metal having an elongation of at least one-sixth, and preferably more than one-fifth, say, one-quarter or more.

The particulate material may include a mine residue, such as slimes of which at least one-quarter by mass may be retained on a 74 micron sieve. The particulate material may form part of a settable cementitious mix, of which the cement content in the mix may be at the most one-fifth by mass.

The layers of reinforcing material may be in the form of welded wire mesh having square grid openings. The welded wire mesh may be annealed after welding. The spacing between adjacent wires in the mesh and the spacing between the layers of reinforcing material may lie within the range of 7 to 30 diameters of the wire. The wire mesh may have grid openings which lie in the range of 50 mm by 50 mm to 75 mm by 75 mm, and may have a wire diameter lying within the range 2,5 mm and 5,6 mm. The wire mesh may have a mass per square meter lying within the range 1 kg to 7,75 kg.

The pillar may be one meter square in cross-section, and may have a height of one meter. The particulate material may have an angle of internal friction lying in the range of 30° to 40°.

The envelope may be in the form of a bag of woven material around the particulate material and around the layers of reinforcing material. The wire mesh may be suspended at different elevations in the envelope via spaced hangers hanging down in the envelope. The envelope may be of square section and the layers of reinforcing material may be square in plan view.

The invention extends further to a reinforcing layer assembly suitable for use in the building of a mine support pillar as described, which includes a plurality of layers of annealed welded steel wire mesh, held at different elevations by a plurality of spaced hangers. The hangers may permit folding together concertina-fashion of the reinforcing layers.

The invention extends also to a pillar in which the particulate material is provided in the form of a plurality of building elements arranged in successive courses on top of one another, in which the layers of reinforcing material are provided within at least some of the building elements, or between at least some of the courses, and in which the envelope around the particulate material is provided by the building elements, singly or in groups, being sheathed or wrapped in synthetic plastics sheet material.

The pillars, made of building elements in courses, may have the layers of reinforcing material between courses in the form of metal sheet. The building elements may be of rectangular section and may have a length two or more times their width.

The invention extends still further to a building element of cementitious mix material, which is of rectangular section, has a length two or more times its width, includes a sheath or wrapping of synthetic plastics material, and which is suitable for use with other similar building elements in building a pillar as described, by arranging the building elements in courses on top of one another.

The invention extends yet further to a building element which is of rectangular section and which has a length two or more times its width, and which includes a settable cementitious mix material having a ductile metal reinforcing mesh material embedded within it, and which is suitable for use with other similar building elements in building a pillar as described, by arranging the building elements in courses on top of one another.

A building element may include an outer sheath or wrapping of synthetic plastics film. The sheath for a building element may be of woven or knitted synthetic plastics material, such as polypropylene or polyethylene. The sheath may be pervious to water to permit egress of water. The sheath is intended to retain the cement in the mix. The cementitious mix as contained in the sheath, and before setting and curing, may be subjected to outside compression to ensure a dense mix. The sheath and its contents may be formed into a building element of uniform cross-section, such as a slab, bar, or sleeper.

The building element may have a thickness which may vary between 3½ cm and 15 cm. The length of a building element may be in the region of one meter or slightly more, and the width may be a convenient fraction of the length so as to facilitate the stacking of building elements in courses in criss-cross fashion to form a pillar of square section. Thus, the width of a building element may be half its length or may be as small as one-sixth its length.

The layers of ductile metal reinforcing material may be annealed and may have an elongation of at least one-quarter. The reinforcing layers may be galvanized after annealing, or they may be provided with protective coats of synthetic plastics material.

Further features of the invention will now become apparent from the following description which is given by way of example with reference to the accompanying diagrammatic drawings.

Figure 1:
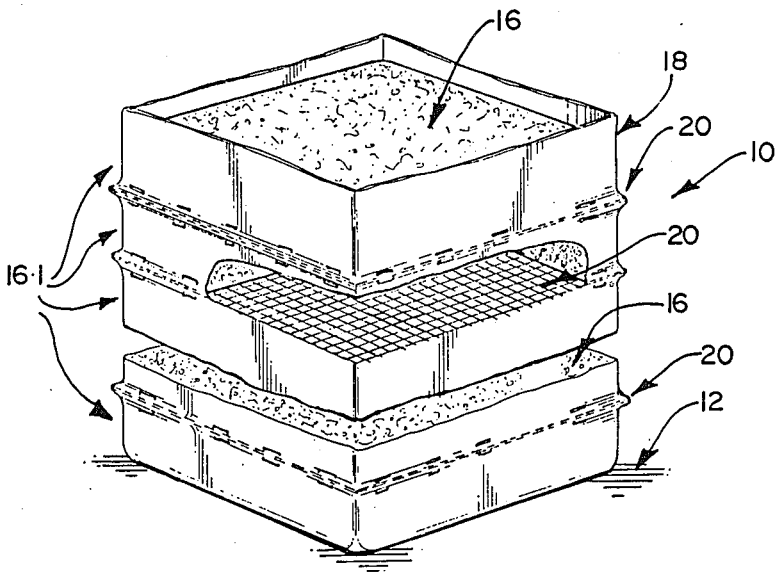
FIG. 1 shows a three-dimensional view of one embodiment of a pillar in accordance with the invention.

Referring to the drawings, a mining support pillar 10 according to the invention, is adapted to provide support between the floor 12 and the roof 14 of a mine, and includes particulate material 16 within an envelope 18 in the form of a bag of synthetic plastics sheet material, and a plurality of layers 20 of reinforcing material of ductile metal at different elevations in or between layers 16.1 of the particulate material, the ductile metal having an elongation of at least one-sixth.

The particulate material 16 includes a mine residue in the form of slimes.

Figure 2:
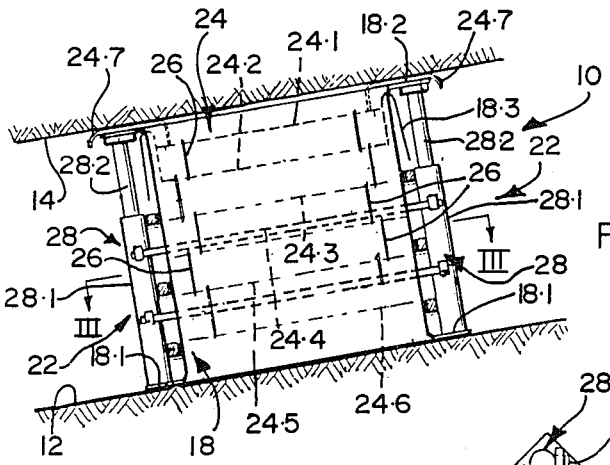
FIG. 2 shows a sectional side elevation at II—II in FIG. 3 of the drawing of a mining support pillar moulding assembly for moulding a pillar in accordance with the invention.
Figure 3:
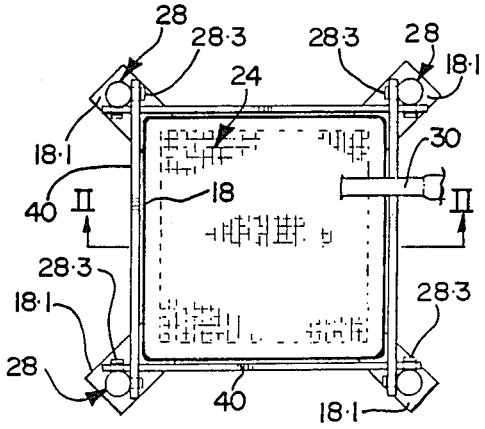
FIG. 3 shows a sectional plan view, at III—III in FIG. 2.

Referring to FIGS. 2 and 3 of the drawings, there is shown another pillar with a moulding assembly, generally indicated by reference numeral 22, for moulding the pillar 10. Reference numeral 22 refers generally to a mining support pillar moulding assembly for moulding a mining support pillar in accordance with the invention.

The assembly 22 includes as envelope in the form of a bag 18 supported between the floor or foot wall 12 and the roof or hanging wall 14 of the mine. Inside the bag 18 there is suspended a reinforcing layer assembly generally indicated by reference numeral 24, made up of a plurality of layers, eg 24.1, 24.2, 24.3, 24.4, 24.5 and 24.6 of reinforcing mesh material at different elevations. The various mesh layers are interconnected via hangers 26 which permit the assembly 24 to collapse or extend concertina-fashion. The bag 18 is supported by means of reclaimable telescopic props 28 bearing against flaps 18.1 on the floor 12 and bearing upwardly against flaps 18.2 at the upper edge of the bag 18 against the roof 14. The assembly 24 is suspended by means of suspension elements 24.7 which are gripped between the flaps 18.2 and the roof or hanging wall 14.

When the assembly 22 is in its erected condition as shown, a cementitious mix having relatively little cement, is pumped into the bag by means of a charging tube 30. The cementitious mix is pumped under pressure into the bag which then fills from the bottom, the mix falling through the openings in the reinforcing mesh layers 24. The particulate material in the cementitious mix includes mine residues, and has about two-fifths by mass of dry particulate material retained on a 74 micron sieve. The cement content of the cementitious mix may be low and can be in the range of one-eighth to one-fifth by mass of the mix.

Figure 4:
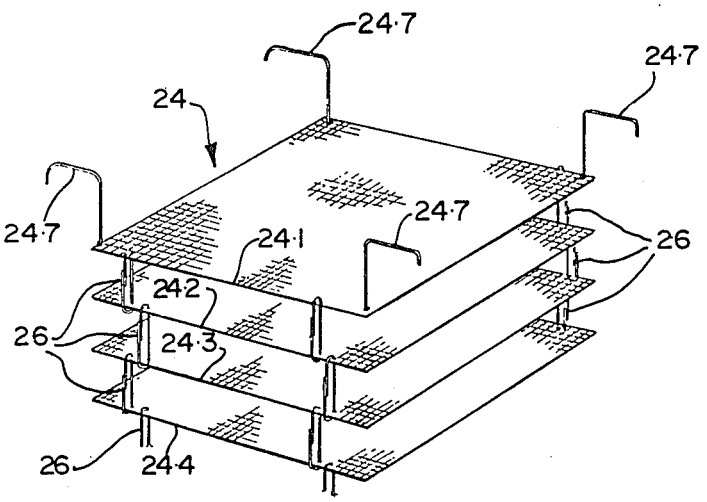
FIG. 4 shows a three-dimensional view of four layers of the reinforcing layer assembly for use in the making of the mining support pillar of FIGS. 2 and 3.

Referring to FIG. 4 of the drawings, the assembly 24 of reinforcing layers 24.1, 24.2, etc. are held in spaced relationship by links 26 at a spacing of about 70 mm. The links 26 permit the various layers 24.1, 24.2, etc. of the assembly 24 to collapse concertina-fashion, and also to expand concertina-fashion, for ease of transport. The reinforcing material of the reinforcing layer of the assembly 24 is of wire mesh having mesh openings of 50 mm by 50 mm and having a wire thickness of about 3 mm. The wire of the wire mesh has an elongation of about one-quarter. Such elongation is obtained by annealing the wire mesh.

The bag 18 is of woven or knitted synthetic plastics material of polypropylene, and is previous to water to permit egress of water but retains the cement of the cementitious mix. The bag is of square section, and may be provided with side flaps 18.3 on each side at the top to permit them being folded over when the bag is full or nearly full.

The reclaimable props 28 are of light-duty and are telescopic having a female base portion 28.1 and a male upper portion 28.2 which is extendible relative to the female portion. In use, the base portion 28.1 seats on the lower ears 18.1, and the male portion 28.2 bears against the upper ears 18.2 of the bag 18. The base portion 28.1 has brackets 28.3 at different elevations for accepting bars 40 to provide a cage to prevent excessive bulging of the bag 18 under internal pressure from the cementitious mix inside.

Figure 5:
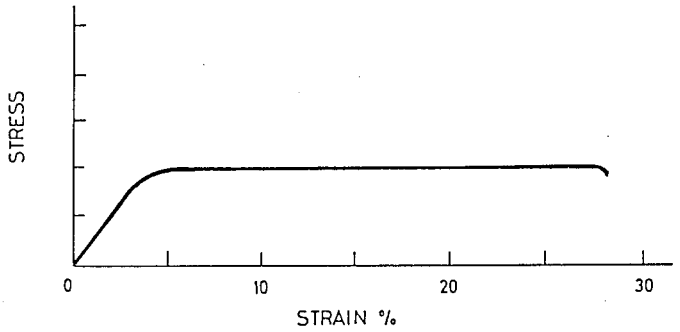
FIG. 5 shows a stress elongation diagram of reinforcing layer material, suitable for use in the making of the mining support pillar according to the invention.

Referring to FIG. 5 of the drawings, there is shown the stress strain (elongation) characteristic of wire after having been annealed. Mild steel wire mesh which has been annealed, has been found to give good results.

Figure 6:
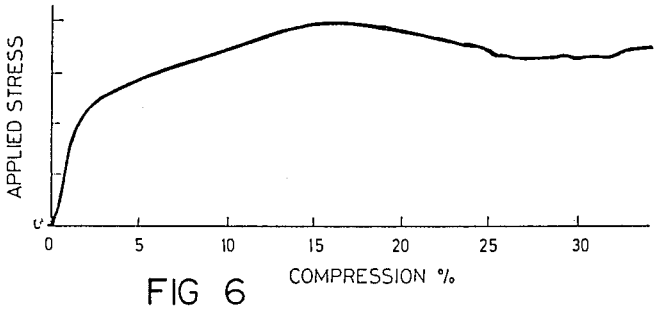
FIG. 6 shows a stress compression diagram of a mining support pillar, when made in accordance with the invention.

Referring to FIG. 6 of the drawings, there is shown a typical load compression characteristic of a minin support pillar in accordance with the invention. Annealed reinforcing mesh with wires of 3,15 mm diameter at a vertical spacing of 70 mm between reinforcing layers 24.1, 24.2, etc. was used. The mesh openings of the wire mesh were 50 mm by 50 mm. The cementitious mix used had a cement content of one-eighth by mass. The particulate material contained mine residues of which two-fifths by mass were retained on a 74 micron sieve. The load characteristic was obtained after the mix had cured for seven days.

It will be noted that the load characteristic of the mining support pillar increases until a compression of about 15% has taken place. Thereafter, further compression takes place, with decreasing load, until about 27% or 28%. Thereafter, the load increases again, with further compression. A desirable feature about the mining support pillar having a characteritic this type, is that there is no sudden failure.

Referring to FIGS. 7 to 14 of the drawings, reference numeral 10.7 refers generally to a mining support pillar which is made by stacking building elements 52 in courses 53 between the foot wall 12 and the hanging wall 14 of a mine. In order to facilitate locating the pillar in position between sloping foot wall and hanging wall, use may be made of a temporary barrier provided by reclaimable props 58 wedged into position by means of wedges 60. Any clearance space 62 between the top of the building elements 52 and the hanging wall 14 may be filled with grout 64. The props 58 may be removed if desired, once the pillar is taking load. Alternatively, the props 58 may be maintained on the low side of the pillar to maintain the integrity of the pillar. For support purposes however, the temporary barrier provided by props 58 is not regarded as taking load.

The building elements 52 are made of a cementitious mix of cement and particulate material, such as mine residue, the cement content being at the most one-fifth by mass. At least one-quarter of the particulate material is retained on a 74 micron sieve. The building elements are contained in envelopes in the form of synthetic plastics sheaths 52.1 which are pervious to water. The sheaths are of woven or knitted synthetic plastics material, such as polypropylene or polyethylene.

The building elements 52 may have layers 52.2 of ductile reinforcing mesh material within them. Alternatively, or in addition, ductile reinforcing mesh material may be provided between courses.

The thickness of the building elements 52 may vary between 50 mm and 150 mm. The length of the building elements may lie within the range of 800 mm to 1200 mm, and the width of the building elements may lie within the range of one-half to one-sixth the length of the building elements.

The dimensions of a building element will be so chosen that it can be easily handled by one or two workmen. For this purpose, building elements should have a mass of, say, from 20 to 60 kg. At the lower end of the range, a building element can be handled by a single workman, whereas at the upper end of the range, two workmen will be needed to handle it.

Figure 7:
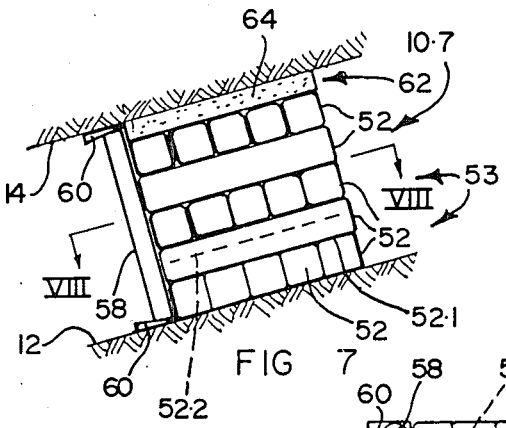
FIG. 7 shows a side view of another embodiment of a mining support pillar in accordance with the invention, shortly after having been built in a mine.
Figure 8:
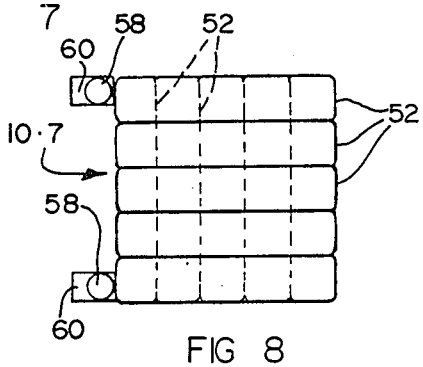
FIG. 8 shows a sectional plan at VIII—VIII in FIG. 7.

In the embodiment of a mining pillar shown in FIGS. 7 and 8 of the drawings, it will be noted that the width of the building element is about one-fifth its length.

Figure 9:
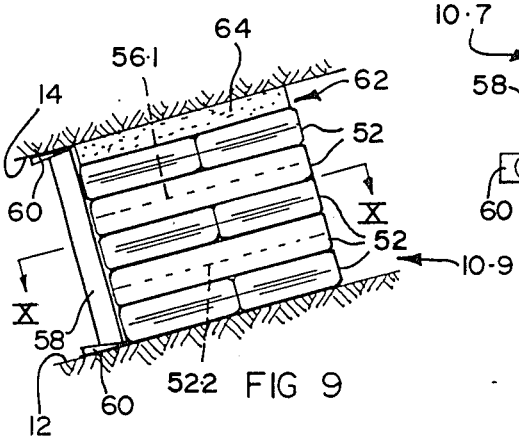
FIG. 9 shows a side view of another embodiment of a mining support pillar in accordance with the invention, using building elements of different proportions of width and length.
Figure 10:
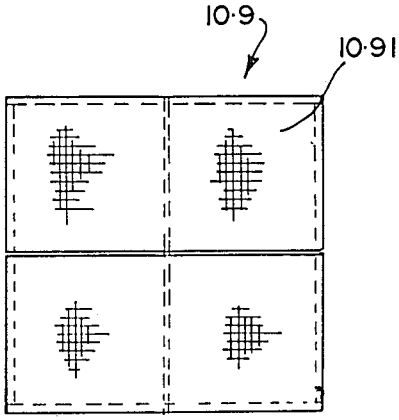
FIG. 10 shows a sectional plan at X—X in FIG. 9.

Referring now to FIGS. 9 and 10 of the drawings, there is shown another pillar 10.9 in which the building elements 52 have a width which is half their length. Such proportions make for relatively easy stacking and building up of a pillar. Where the length of the slab is one meter, then a pillar of one meter square can easily be built by laying the building elements criss-cross fashion in alternate courses. The building elements 52 have reinforcing layers 52.2 of ductile welded mesh material within them.

When building pillars of one meter square, ductile reinforcing mesh 10.91 may be provided in one meter squares which can then be used for laying between courses. When reinforcing layers are provided between courses of building elements, then reinforcing layers within building elements may be dispensed with.

Figure 11:
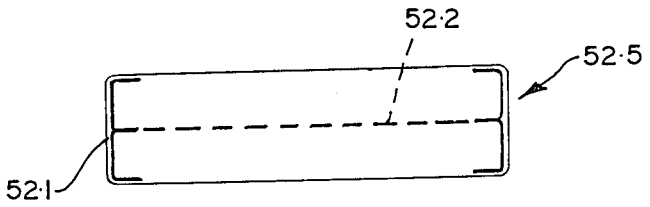
FIG. 11 shows an end view of a synthetic plastics sheath with reinforcing inside, prior to charging with cementitious mix.
Figure 12:
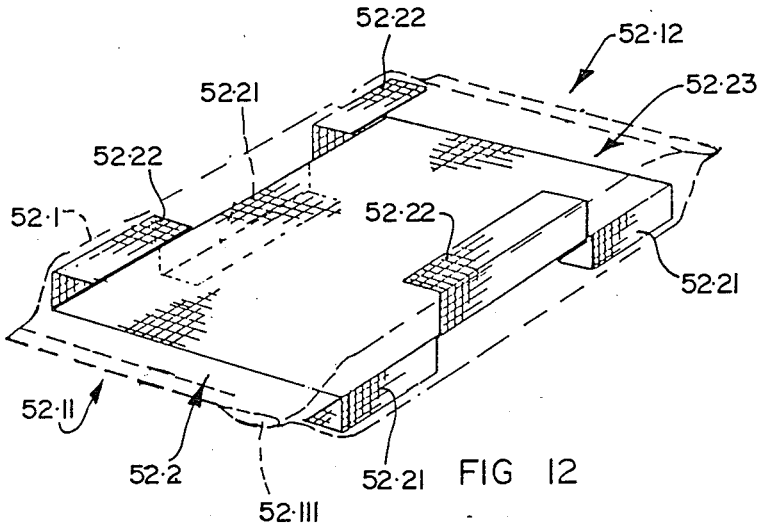
FIG. 12 shows a three-dimensional oblique end view of the assembly of FIG. 11.

Referring now to FIGS. 11 and 12 of the drawings, there is shown a sheath and reinforcing layer assembly 52.5 which includes a sheath 52.1 with a reinforcing element 52.2 of ductile mesh inside it. The sheath 52.1 may be stitched or shaped to have a rectangular cross-section. Alternatively, it may be round, which can then be formed into rectangular cross-section by the reinforcing element 52.2 inside it. The reinforcing element 52.2 has turned-over edges 52.21 and 52.22 which ensure that the centre portion 52.23 of the reinforcing element 52.2 is centrally located within the thickness of the sheath 52.1. The sheath 52.1 is closed off at both ends 52.11 and 52.12, except for a charging opening 52.111 in the end 52.11. These sheath and reinforcing layer assemblies 52.5 may be transported down the mine and may be filled underground at a work place near the work face. The building elements, after cementitious mix has been charged into the sheath and reinforcing layer assembly, may be left to set and cure at the work place.

Figure 13:
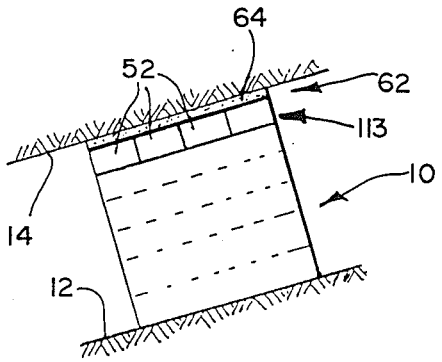
FIG. 13 shows a side view of another embodiment of a mining support pillar in accordance with the invention.
Figure 14:
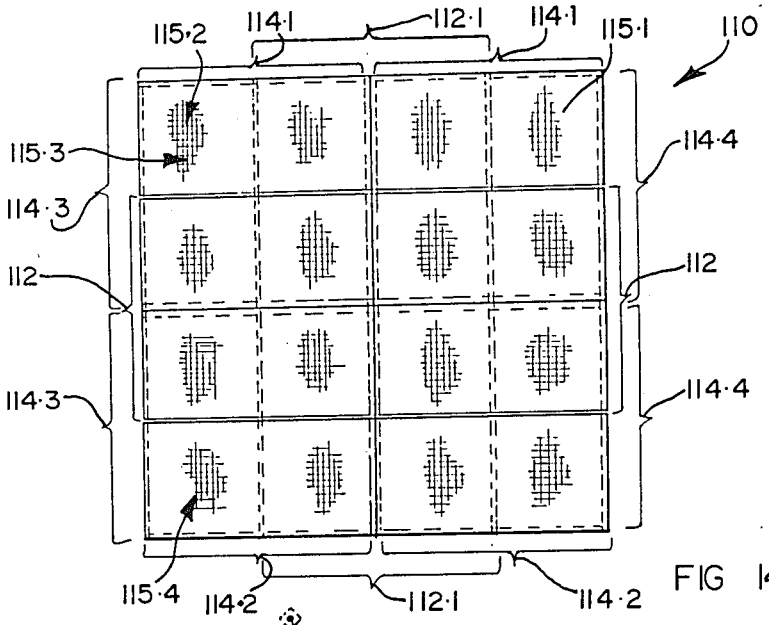
FIG. 14 shows a plan view of a composite pillar made up of for smaller pillars in square cross-sectional form, where tall pillars are required.

Referring to FIG. 13 of the drawings, there is shown an alternative mining support pillar comprising a base pillar 10 made up in any desired way, but which may conveniently be made up as described with reference to FIGS. 1 to 6 of the drawings. A difficulty with pillars 10 is that sometimes the stope height varies and is sometimes somewhat greater than the overall height of a pillar 10. The clearance space left between the top 10.4 of the pillar 10 may then be filled in by building elements as described above, either in a single course 113 or in more than one course. Any clearance space 62 which there may still then be between the course 113 of building elements and the hanging wall 14, may be filled in with grout 64.

The invention accordingly extends also to the method of making a mining support pillar which includes making a base pillar 10, and which includes the further step of filling in the clearance space 62 above the top of the base pillar 10 with one or more courses 113 of building elements 52 as described.

It is generally preferable to have the cross-sectional dimension of a mining support pillar at least the same as its height. Where stope widths are wide, eg say between one and a half and two meters or more, then it may become desirable to build wider pillars to ensure a high load-carrying capacity (see FIG. 14). Such pillars can then be built as composite pillars 110, by making use of the building elements, shown for FIGS. 9 and 10 of the drawings. Building elements having widths half their lengths are well suited to building up a composite pillar which, in fact, comprises four pillars side-by-side, of the type shown in FIGS. 9 and 10 of the drawings.

In order to ensure that there is adequate bonding or interlocking between the various courses of the four constituent pillars, four building elements will be laid in a row alongside one another in a first course, as indicated by brackets 112. Thereafter, in the same course, two building elements 114.1 will be laid end-to-end across the ends of the row of four elements indicated by brackets 112. Similarly, building elements 114.2 will be laid end-to-end across the opposite ends of the four elements indicated by brackets 112. The layers 115.1 and 115.2 of reinforcing mesh are of oblong shape having a length twice their width and are laid alongside one another on top of the first course of elements.

For the next course, building elements will be laid in a row alongside one another, as indicated by brackets 112.1 in a direction across row 112. Thereupon, two building elements 114.3 will be laid end-to-end across the ends of the row of four building elements 112.1. Similarly, two building elements 114.4 will be laid end-to-end across the ends of the row of four building elements 112.1. The reinforcing layers of mesh 115.3 and 115.4 on the next course are laid in the opposite direction to the layers 115.1 and 115.2 of the first course.

Where tall pillars are required, they may be built up by superimposing squat pillars on top of one another, with rigid slabs or plates separating them. Thus, a checker plate may be used as a divider between superimposed squat pillars. By squat pillar is meant one whose height does not exceed its minimum transverse dimension.

The squat pillars referred to above may be made by laying building elements in courses as described above. Alternatively, the squat pillars may be made by charging a settable cementitious mix into a bag of woven or knitted synthetic plastics material, ductile reinforcing material being provided in layers at different elevations within the cementitious material within the bag, as described before.

In order to get random jointing between successive courses, there may be provided two sizes of building elements, namely a square one, and an oblong building element having a length twice its width.

Figure 15:
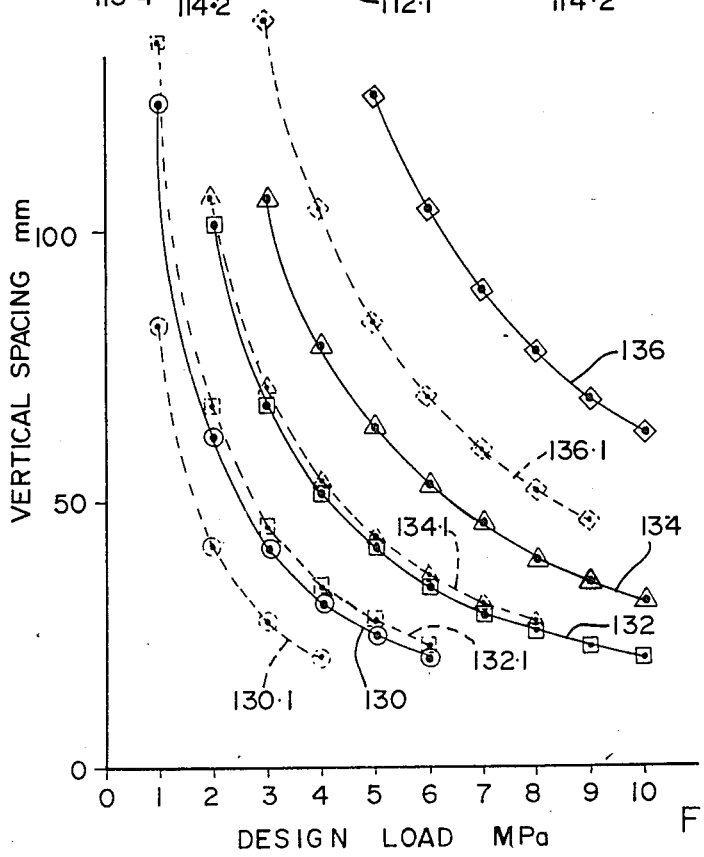
FIG. 15 shows graphically how the load-bearing characteristics of pillars in accordance with the invention, vary with different types of ductile mesh reinforcing layers.

Referring to FIG. 15 of the drawings, there are shown graphically the calculated load-bearing capacities in MPa of different pillars having dimensions of one meter cube with steel reinforcing square mesh layers of different wire thicknesses, in relation to the vertical spacing in millimeters between such layers, when using mine residue in the form of slime as the particulate material. Curves 130, 132, 134, and 136 relate to reinforcing mesh having grid openings of 50 mm×50 mm and made up of wire thicknesses 2,5 mm, 3,15 mm, 4 mm, and 5,6 mm respectively. The masses of the reinforcing layers per square meter are 1,60 kg, 2,54 kg, 4,12 kg, and 7,76 kg.

When the reinforcing layers have grid openings of 75 mm×75 mm with the same wire diameters than their masses per square meter are somewhat lower, namely 1,07 kg, 1,69 kg, 2,74 kg, and 5,38 kg for the respective wire diameters. The load-bearing characteristics of pillars in which reinforcing layers of 75 mm×75 mm mesh are used relative to the spacing between such layers in the pillars, are shown by curves 130.1, 132.1, 134.1, and 136.1 for the respective wire diameters.

From the curves it will be noted that a pillar designed to take a load of 5 tonnes will need layers of reinforcing square mesh with wire diameter of 5,6 mm and 75 mm×75 mm grid openings at a vertical spacing of, say, 80 mm between layers. Alternatively, the pillar will need 50 mm×50 mm square mesh reinforcing layers with wire diameter of 4 mm, at a vertical spacing of, say, 65 mm.

Pillars of one meter cube can be designed roughly for other load-bearing capacities, by making use of the curves shown in FIG. 15.

In order to cater for loads encountered in the mines of South Africa, the use of the layers of reinforcing material described above at the vertical spacings ascertainable from the curves of FIG. 15, amounts to about 20 kg to 90 kg per cubic meter of pillar.

In use, when a pillar is taking load, the envelope contains the particulate material and maintains the integrity of the pillar by preventing loss of particulate material due to spalling.

What I claim is:

1. A mining support pillar adapted and constructed to provide support between the floor and the roof of a mine, comprising:

an envelope in the form of a bag having an upper end and a lower end, which envelope is filled with particulate material;

said envelope extending upwardly from the floor to the roof of the mine;

support means at the upper end of said bag;

said bag being made of water pervious synthetic plastic sheet material so as to permit water to drain from the contents of the bag during erection of the pillar; and a plurality of layers of welded wire mesh reinforcing material made of ductile metal located at a variety of elevations within the particulate material in the envelope, said ductile metal having an elongation of at least one-sixth;

said layers of reinforcing material being generally square in plan view and havings square grid openings.

2. The pillar according to claim 1 further including a plurality of temporary removable props having an upper end and a lower end, said props spaced peripherally around the bag and extending upwardly from the floor to the roof of the mine;

the upper ends of the props engaging with the bag support means and urging the bag support means against the roof of the mine.

3. The pillar according to claim 1 wherein the envelope is of square section around the particulate material and around the layers of reinforcing material.

4. The pillar according to claim 1 wherein the particulate material includes a mine residue in the form of slimes, the particle size of said particulate material being such at at least one quarter of said particulate material is retained on a 74 micron sieve.

5. The pillar according to claim 1 wherein the particulate material includes a settable cementitious mix having a cement content of not more than one-fifth by mass.

6. The pillar according to claim 1 wherein the required ductility of the layers of wire mesh reinforcing material is obtained by using annealed welded steel wire mesh.

7. The pillar according to claim 1 wherein the spacing between adjacent wires in the mesh is in the range of 7 to 30 diameters of the wire.

8. The pillar according to claim 1 wherein the spacing between the layers of reinforcing material lies within the range of 7 to 30 diameters of the wire.

9. The pillar according to claim 1 wherein the wire mesh has grid openings in the range of 50 mm by 50 mm to 75 mm by 75 mm, and which has a wire diameter lying within the range of 2.5 mm and 5.6 mm.

10. The pillar according to claim 1 wherein the wire mesh has a mass per square meter of between 1 kg to 7.75 kg.

11. The pillar according to claim 1 wherein the mass of its layers of reinforcing material is from 20 to 90 kg per cubic meter of pillar.

12. A method for making a mining support pillar to provide support between the floor and the roof of a mine comprising:

providing an envelope in the form of a bag of pervious synthetic plastic sheet material between the roof and floor of the mine, said bag having an upper end and a lower end;

providing within the bag a plurality of layers of reinforcing material at different elevation;

charging a pumpable particulate material under pressure via a delivery tube into the bag, the particulate material comprising at least some mine residue in the form of slimes;

suspending the bag downwardly from the roof of the mine, and suspending the layers of the reinforcing material within the bag, the layers being generally square in plan view and being of annealed welded steel wire mesh having square grid openings.

13. The method according to claim 12 wherein the particle size of the slimes portion of the particulate material is such that at least one-quarter is retained on a 74 micron sieve.

14. The method according to claim 12 wherein the bag has support means at its upper end, and wherein the support for the envelope is provided by a plurality of temporary removable props spaced peripherally around the bag, the props extending upwardly form the floor of the mine to the roof of the mine, the upper ends of the props engaging with and urging the bag support means against the roof of the mine.

* * * * *